US007131563B2

(12) United States Patent
Wen

(10) Patent No.: US 7,131,563 B2
(45) Date of Patent: Nov. 7, 2006

(54) NAIL DRIVER BUMPER

(75) Inventor: Ming-Han Wen, Taipei Hsien (TW)

(73) Assignee: De Poan Pneumatic Corp., Taipei Hsien (TW)

( * ) Notice: Subject to any disclaimer, the term of this patent is extended or adjusted under 35 U.S.C. 154(b) by 0 days.

(21) Appl. No.: 11/044,353

(22) Filed: Jan. 28, 2005

(65) Prior Publication Data

US 2006/0169736 A1 Aug. 3, 2006

(51) Int. Cl.
*B25C 1/04* (2006.01)

(52) U.S. Cl. ..... 227/130; 173/211

(58) Field of Classification Search ..... 227/8, 227/130, 156; 173/210, 211; 267/152, 153
See application file for complete search history.

(56) References Cited

U.S. PATENT DOCUMENTS 3,496,840 A * 2/1970 Dorney et al. ..... 92/85 R
4,441,644 A * 4/1984 Farian ..... 227/130
4,509,669 A * 4/1985 Elliesen ..... 227/130
4,609,135 A * 9/1986 Elliesen ..... 227/130
4,932,480 A * 6/1990 Golsch ..... 173/210
5,025,971 A * 6/1991 Schafer et al. ..... 227/156
5,131,579 A * 7/1992 Okushima et al. ..... 227/8
6,779,698 B1 * 8/2004 Lin ..... 227/130
6,779,699 B1 * 8/2004 Aoki et al. ..... 227/130

* cited by examiner

*Primary Examiner*—Scott A. Smith

(57) ABSTRACT

A nail driver bumper comprises an inner pad and an outer pad which are made of heat-resisting elastomer material. A plurality of axial ribs is arranged between the inner pad and the outer pad. An axial slot is formed between two adjacent axial ribs. A top of each axial slot is communicated to the lower chamber of the cylinder. An axial channel and a radial channel are formed at the lower end of each axial slot. The entire axial channels and the radial channels are communicated with the axial slots and the central hole of the inner pad so as to communicate to the lower chamber. Thus, a plurality of air paths is informed between the inner pad and the outer pad so as to increase the surface area for an ability of preferred heat dissipating, and prolong the lifetime of the bumper.

6 Claims, 5 Drawing Sheets

NAIL DRIVER BUMPER

FIELD OF THE INVENTION

The present invention relates to nail drivers, and particularly to a pail driver bumper which has a preferred impact power absorption effect and heat dissipating ability. The nail driver bumper has a preferred ability to suffer the impact of a nail-beating piston so as to prolong the lifetime of the bumper. The nail driver bumper has an annular inner pad and outer pad and air paths are formed between the inner pad and outer pad.

BACKGROUND OF THE INVENTION

The nail driver bumper is located at a bottom of the cylinder of the nail driver body for absorbing the impact of the nail-beating piston when the nail-beating piston beats downwards so that the nail-beating piston will not be destroyed.

It is known that the conventional nail driver bumper is made of elastomer material. However the repeated operation of the nail-beating piston will generate high temperature to the nail driver bumper so that the bumper is easy to crack and thus the lifetime is shortened. To overcome this problem, it is necessary to make the nail driver bumper with heat-resisting elastomer material.

Furthermore, the heat dissipation of the bumper is not preferred. This is also disadvantageous to the bumper. The conventional single ring or double ring nail driver bumper is not sufficient to solve the defect in the prior art.

SUMMARY OF THE INVENTION

Accordingly, the primary object of the present invention is to provide a nail driver bumper which has a preferred impact power absorption effect and heat dissipating ability. The nail driver bumper has the preferred ability to suffer the impact of a nail-beating piston so as to prolong the inner pad and outer pad to outer side through the hole so as to increase the heat dissipation ability and prolong the lifetime of the nail driver bumper of the present invention.

The various objects and advantages of the present invention will be more readily understood from the following detailed description when read in conjunction with the appended drawing.

DETAILED DESCRIPTION OF THE INVENTION

Figure 1:
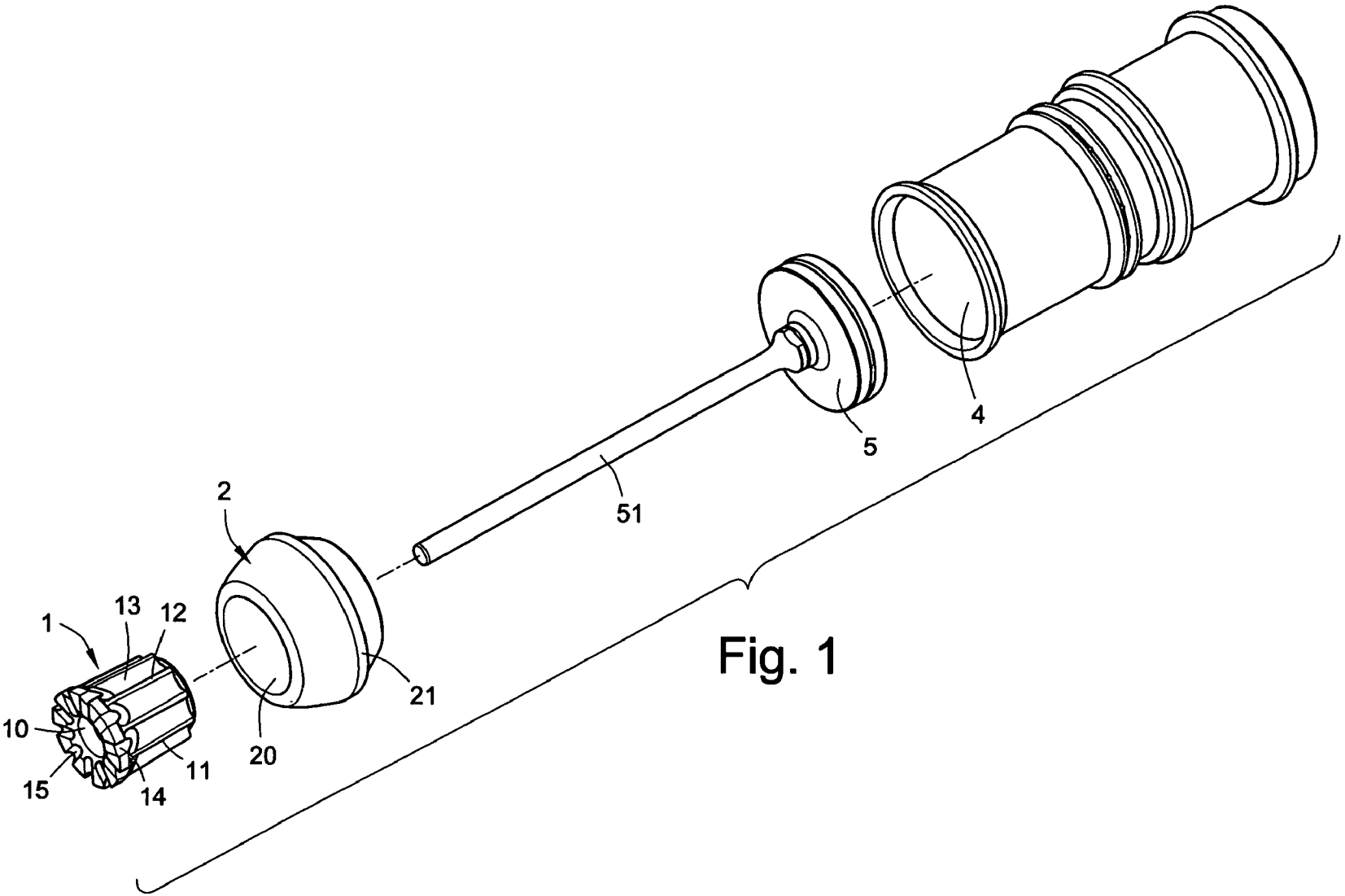
FIG. 1 is an exploded perspective view of the first embodiment of the present invention, where it is illustrated that a lower side of a nail driver bumper with a nail-beating piston is installed with an inner pad and an outer pad.
Figure 2:
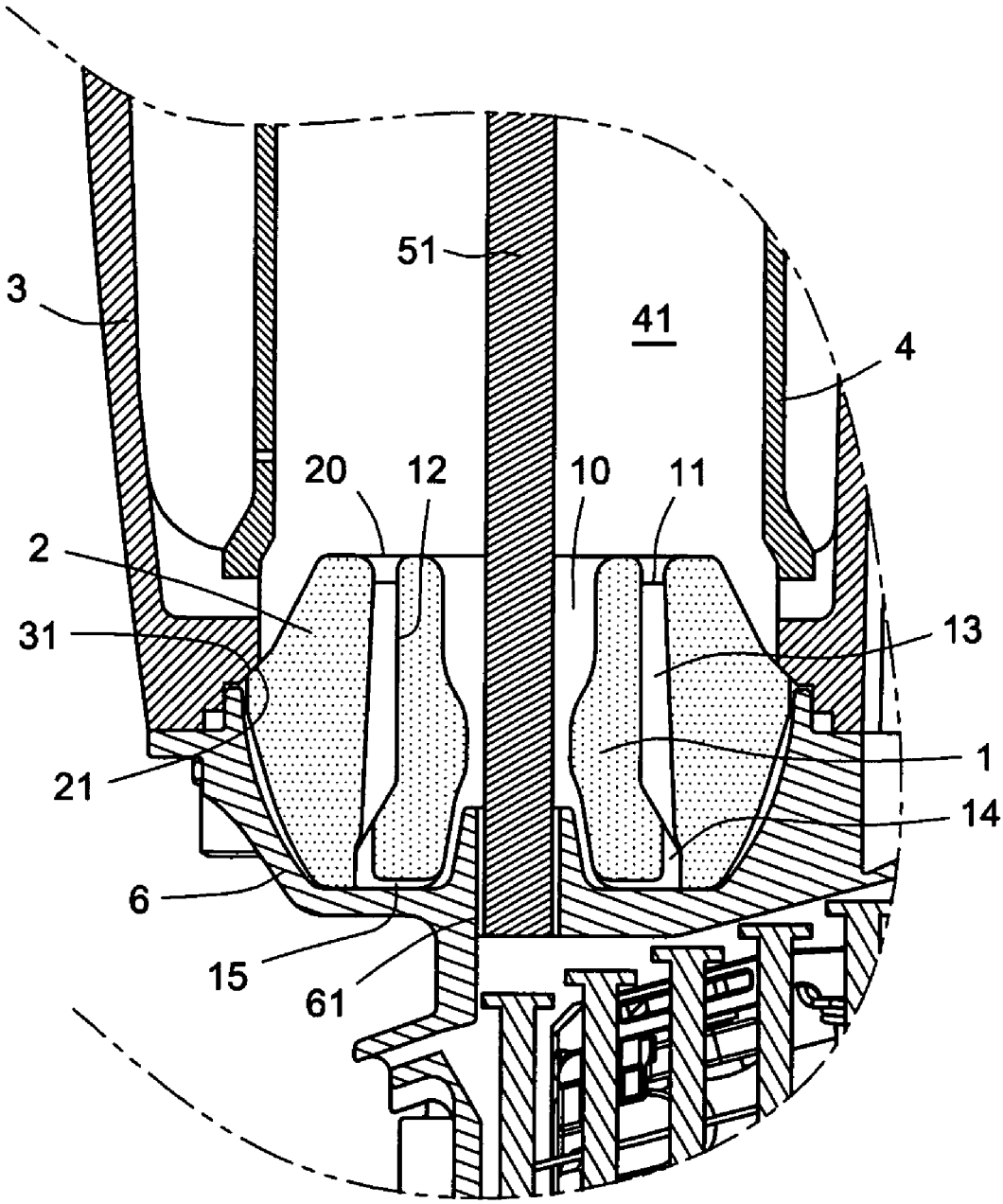
FIG. 2 is a schematic view of the first embodiment of the present invention, where it is illustrated that the inner pad is embedded into the outer pad, and the outer pad is embedded into a groove in the gun body.
Figure 3:
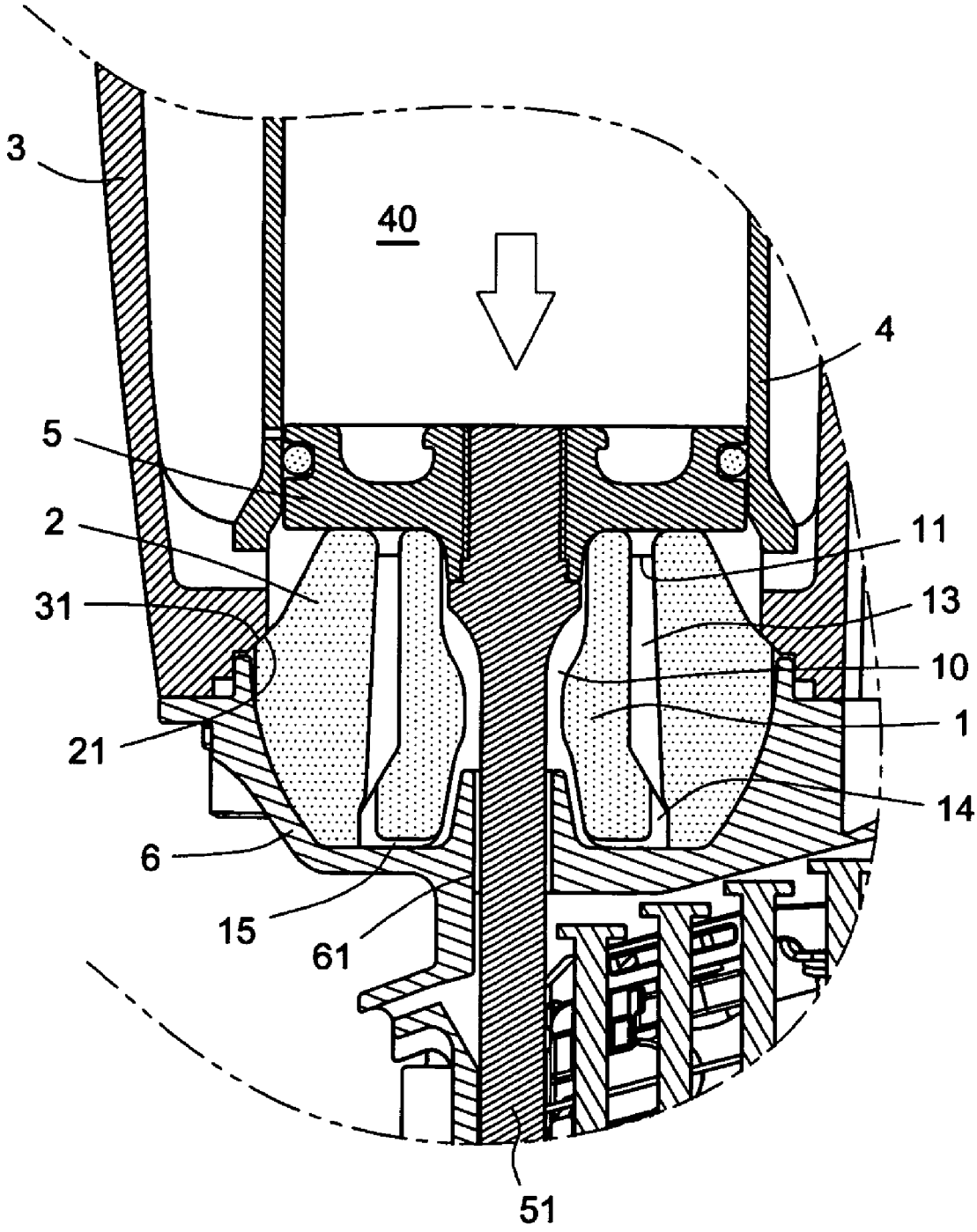
FIG. 3 is another cross sectional view about the first embodiment of the present invention, it is illustrated that the nail-beating piston presses through the inner pad and outer pad.
Figure 4:
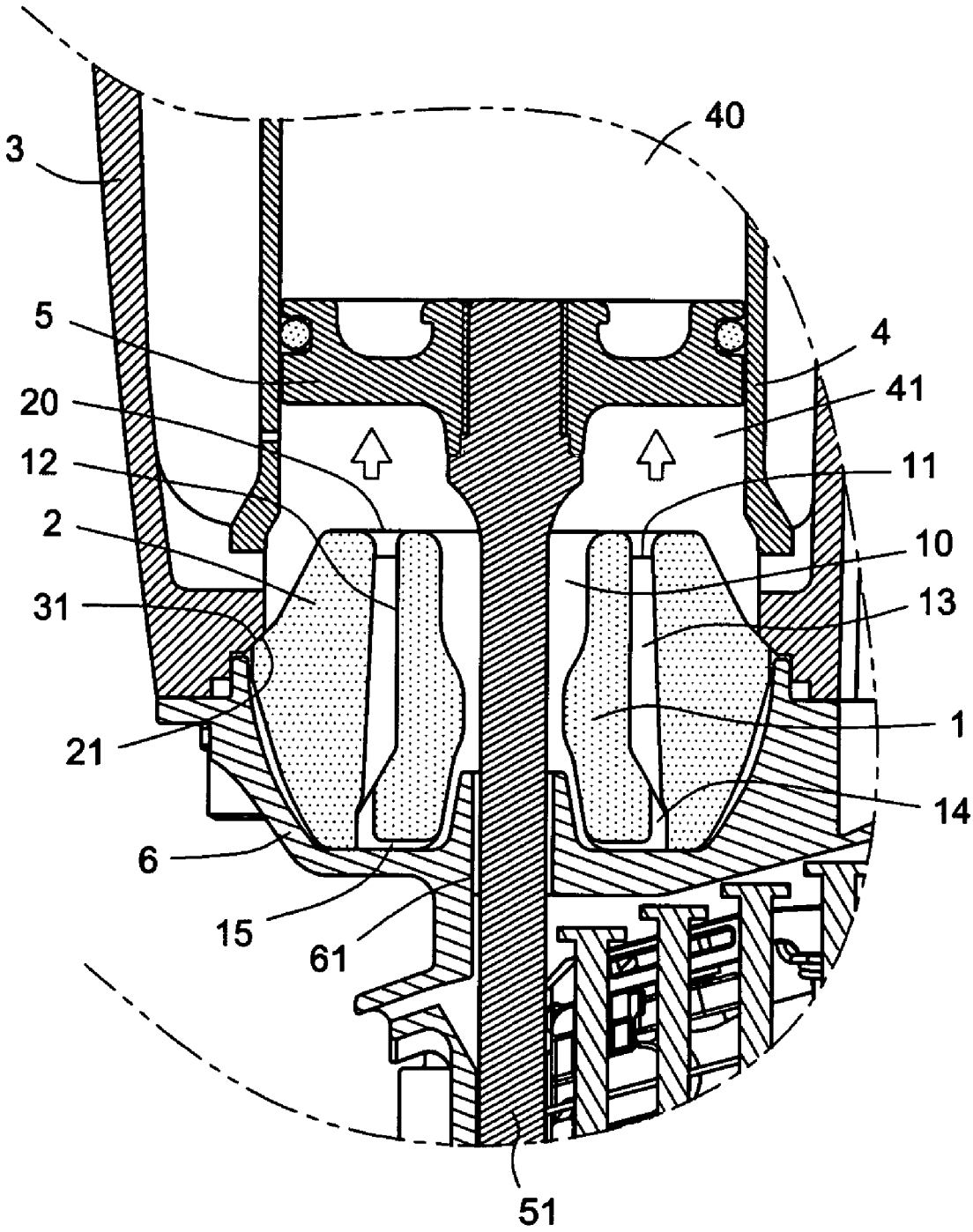
FIG. 4 is a further cross sectional view about the first embodiment of the present invention, where it is illustrated that the inner pad and outer pad are restoring after the nail-beating piston presses downwards.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 4, the first embodiment about the nail driver bumper of the present invention is illustrated. The bumper is formed by an inner pad 1 and an outer pad 2 which are made of heat-resisting elastomer material (such as heat tolerant rubber). The nail driver bumper is assembled within a bottom of a cylinder 4 (referring to FIG. 2). A nail-beating piston 5 is installed within the cylinder 4 so as to movably isolate the cylinder 4 as an upper chamber 40 and a lower chamber 41 (referring to FIG. 4). A bottom of the nail-beating piston 5 is formed with a nail-beating rod 51 which passes through the bottom of the lower space 41. A lower side of the lower chamber 41 has a seat 6 which is fixed to a bottom of the driver body 3. The seat 6 has a hole 61 for passing through the nail-beating rod 51. The hole 61 has a size larger than the size of the nail-beating rod 51 so that the nail-beating rod 51 passes through the hole 61, a gap is formed between the hole 61 and the nail-beating rod 51 for ventilating air.

The inner pad 1 is formed as a ring. A central hole 10 is informed on the inner pad 1 for passing through the nail-beating rod 51 (referring to FIGS. 1 and 2). An out wall of the inner pad 1 is formed with a plurality of axial ribs 11 which are arranged as a radiation pattern. An outer wall 12 of each axial rib 11 is formed as an oblique tapered surface. An axial slot 13 is formed between two adjacent axial ribs 11. A top of each slot 13 is communicated to the lower chamber 41. A radial channel 15 is formed at the lower end of each axial slot. An axial channel 14 and a radial channel 15 are formed at the lower end of each axial slot 13. The entire axial channels 14 and the radial channels 15 are communicated with the axial slots 13 and the central hole 10 of the inner pad 1 so as to communicate to the lower chamber 41.

The outer pad 2 is an annular ring structure. A center of the outer pad 2 has a central hole 20 which is oblique and tapered. The oblique angle of the central hole 20 is identical to that of the outer wall 12 of each axial rib 11 so that when the inner pad 1 is embedded into the central hole 20 of the outer pad 2, the outer wall 12 of each axial rib 11 is adhered to the wall of the central hole 20. Furthermore, an outer wall of the outer pad 2 is formed with at least one stopper 21. In this embodiment, the stopper 21 may be embedded into a groove 31 in the driver body 3 at a lower end of the cylinder 4.

By above mentioned structure, the axial slot 13, axial channels 14, radial channels 15 between the inner pad 1 and outer pad 2 and the central hole 10 of the inner pad 1 are formed with a plurality of air paths in the bumper which is communicated to the lower chamber 41 and the gap of hole 61. The air paths have the effect of increasing the surface area of the inner pad 1 and outer pad 2. Therefore, when the nail-beating piston 5 beats a nail downwards (referring to FIG. 3), the air in the lower chamber 41 and the heat energy absorbed between the inner pad 1 and the outer pad 2 are guided to the hole 61 and then are exhausted to outside. When the nail-beating piston 5 restores upwards (referring to FIG. 4), the air pressure in the lower chamber 41 is still larger than atmosphere. Thereby the air in the lower chamber 41 will flow through the air paths between the inner pad 1 and outer pad 2 to outer side through the hole 61; so as to increase the heat dissipation ability of the nail driver bumper of the present invention.

The above mentioned air paths can also be used as an expansion space when the inner pad 1 and the outer pad 2 are beaten by the nail-beating piston 5. The radial channels 15 at the lower section of the inner pad 1 have a larger bottom area. The radial width of the stopper 21 of the outer pad 2 is greater so as to increase the strength of the nail driver bumper to have the impact power absorption effect and prolong the lifetime of the bumper.

Figure 5:
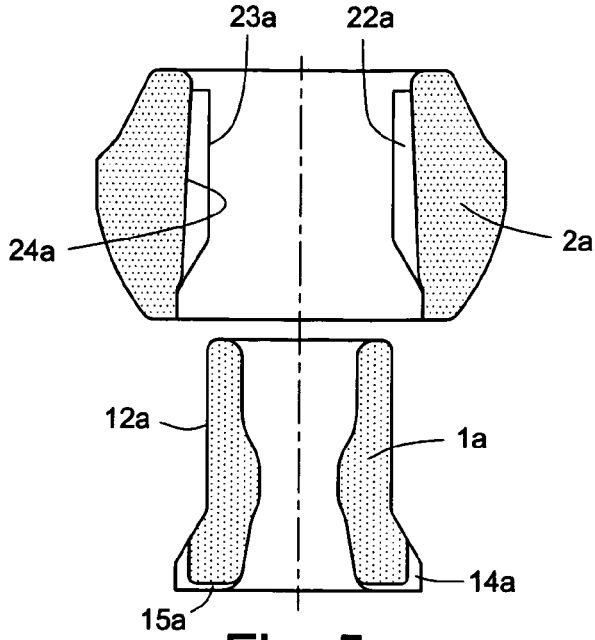
FIG. 5 is an exploded cross sectional view about the second embodiment of the present invention, wherein the plurality of axial ribs are made on the inner wall of the outer pad.

Referring to FIG. 5, a second embodiment of the present invention is illustrated. In this the present invention, the axial ribs 11 in the first embodiment is replaced by a plurality of axial ribs 22*a* on the inner wall 24*a* of the outer pad 2*a* which are arrangement with an equal distance. An outer wall 23*a* of each axial rib 22*a* has an oblique tapered shape. The inner pad 1*a* has an oblique tapered surface 12*a* for receiving the oblique tapered outer wall 23*a* of the axial rib 22*a*. An axial slot 24*a* is formed between two axial ribs 22*a*. Thus, the axial slots 24*a* can communicate with the axial channels 14*a* and radial channels 15*a* at the lower end of inner pad 1*a* so as to form the same air paths as the above first embodiment of the present invention.

Besides the above axial channels and radial channels at the lower side of the inner pad can be replaced by another design, where the axial ribs are made at the lower end of inner wall of the outer pad so that axial channels and radial channels are made on the outer pad.

Figure 6:
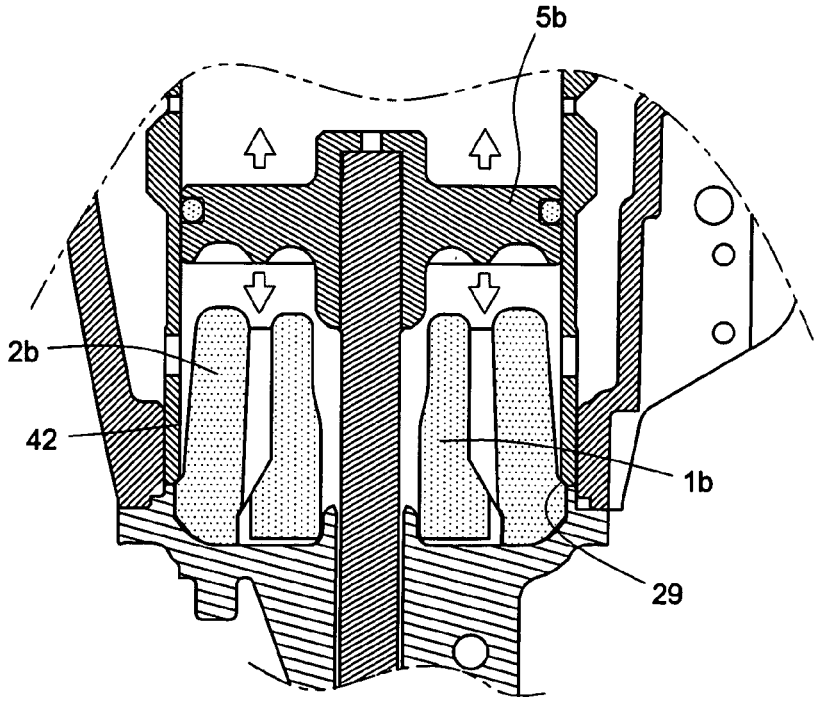
FIG. 6 shows a cross sectional view of the third embodiment of the present invention, where the inner pad is embedded into the outer pad and the outer pad is embedded into a lower end of the wall of the cylinder.

FIG. 6 shows the third embodiment of the present invention, wherein the inner pad 1*b* and outer pad 2*b* are made with shapes capable of being adhered by the nail-beating piston 5*b* so that the inner pad 1*b* and outer pad 2*b* suffer the impact force of the nail-beating piston 5*b* so as to have a preferred bumper effect. Besides, the difference from above embodiment is that the stopper 29 is made at a lower end of the lower cylinder wall so that the inner pad 1*b* and outer pad 2*b* are firmly secured.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nail driver bumper comprising an inner pad and an outer pad which are made of heat-resisting elastomer material; the nail driver bumper being assembled within a bottom of a cylinder; a nail-beating piston being installed within the cylinder to isolate the cylinder into an upper chamber and a lower chamber as the nail-beating piston moves; a bottom of the nail-beating piston being formed with a nail-beating rod; a central hole is formed on the inner pad for receiving the nail-beating rod; a central hole is formed on the outer pad, the inner pad being embedded into the central hole of the outer pad; a lower side of the lower chamber having a seat which is fixed to a bottom of a driver body; the seat having a hole for receiving the nail-beating rod; a gap formed between the seat hole and the nail-beating rod for ventilating air;

a plurality of axial ribs arranged between the inner pad and the outer pad; the axial ribs being arranged to have a radiation pattern; an axial slot being formed between two adjacent axial ribs; and a top of each axial slot being communicated to the lower chamber; an axial channel and a radial channel being formed at a lower end of each axial slot; the axial channel and radial channel of each axial slot being communicated with the axial slots and the central hole of the inner pad so as to communicate with the lower chamber; thus forming a plurality of air paths between the inner pad and the outer pad in the bumper which is communicated to the lower chamber and the gap.

2. The nail driver bumper as claimed in claim 1, wherein an outer wall of the inner pad is formed with the plurality of axial ribs; the outer wall of each axial rib being formed as an oblique tapered surface; the center hole of the outer pad is an oblique tapered hole; an oblique angle of the oblique tapered hole is identical to that of the outer wall of each axial rib so that when the inner pad is embedded into an oblique tapered hole of the outer pad, the outer wall of each axial rib is adhered to the wall of the oblique tapered hole.

3. The nail driver bumper as claimed in claim 1, wherein the plurality of axial ribs are formed on the wall of the center hole of the outer pad; an outer wall of the each axial rib is an oblique tapered surface; and an outer wall of the inner pad is an oblique tapered surface; an oblique angle of the oblique tapered surface of the inner pad is identical to that of the axial ribs so that when the inner pad is embedded into the central hole of the outer pad, the outer wall of each axial rib is adhered to the wall of the inner pad.

4. The nail driver bumper as claimed in claim 1, wherein an outer wall of the outer pad is formed with at least one stopper, the stopper is embedded into a groove in the driver body at a lower end of the cylinder.

5. The nail driver bumper as claimed in claim 1, wherein an outer wall of the outer pad is formed with at least one stopper, the stopper is embedded into a lower end of a wall of the cylinder.

6. The nail driver bumper as claimed in claim 1, wherein when the nail-beating piston beats downwards and upwards, the heat energy absorbed between the inner pad and the outer pad is guided to the gap and then are exhausted to outside.

* * * * *